United States Patent [19]

Wiley et al.

[11] 4,384,686

[45] May 24, 1983

[54] CENTERLINE WEB GUIDE APPARATUS

[75] Inventors: Thomas W. Wiley, Asheville; William R. Joyce, Gerton, both of N.C.

[73] Assignee: Tex-Fab, Inc., Gerton, N.C.

[21] Appl. No.: 266,372

[22] Filed: May 18, 1981

[51] Int. Cl.[3] ..... B65H 25/26

[52] U.S. Cl. ..... 242/57.1; 226/20

[58] Field of Search ..... 242/57.1; 226/3, 15, 226/16, 17, 18, 19, 20, 21, 22, 23; 250/548, 561, 571

[56] References Cited

U.S. PATENT DOCUMENTS

| | | | |
|---|---|---|---|
| 1,945,981 | 2/1934 | Quinby | 242/57.1 |
| 2,666,639 | 1/1954 | Frommer | 271/2.6 |
| 2,871,013 | 1/1959 | Markey | 271/2.6 |
| 3,096,919 | 7/1963 | Snyder | 226/3 |
| 3,254,300 | 5/1966 | Prell | 226/20 X |
| 3,323,699 | 6/1967 | Bricker, Jr. | 226/15 |
| 3,325,072 | 6/1967 | Black et al. | 226/20 |
| 4,054,251 | 10/1977 | Henderson et al. | 242/57.1 |
| 4,106,715 | 8/1978 | Pisani | 226/20 |

*Primary Examiner*—Edward J. McCarthy
*Attorney, Agent, or Firm*—Luedeka & Neely

[57] ABSTRACT

A centerline web guide apparatus for detecting the transverse position of the centerline of a longitudinally moving web of material unwinding from a supply roll and transversely shifting the supply roll to maintain the position of the web centerline along a desired path has two photoelectric detectors located at the opposite longitudinal edges of the web. The photoelectric detectors continuously move back and forth generally transversely of the web continuously monitoring the position of the longitudinal edges of the web. The supply roll of material is supported on a frame which is movable transversely of the web by, for example, an electric motor. As the moving photoelectric detectors detect the longitudinal edges of the web, they send an appropriate signal to the motor controlling the movement of the support frame to transversely move the support frame in an appropriate direction transversely of the web to maintain the centerline of the web in a constant position along the desired path.

10 Claims, 3 Drawing Figures

CENTERLINE WEB GUIDE APPARATUS

The present invention relates to advancing material of indeterminate length; and more particularly to positioning the material transversely by a shiftable material support responsive to material edge detectors.

There are numerous situations wherein process operations are performed on a moving web of material which require that the moving web be maintained in alignment along a desired path. Such process operations include, for example, printing or coating the moving web, slitting the moving web lengthwise, and cutting the moving web transversely to form patches of material.

In some situations, the alignment of a moving web can be accomplished by using a single web edge detector positioned at one lateral edge of the moving web. As the web edge detector senses a transverse displacement of the web edge in one direction it causes the moving web to shift transversely in the other direction to maintain the alignment of the moving web.

In other situations, the width of the moving web may vary to such a substantial extent or the longitudinal edges of the web may either move in corresponding directions or relative to each other to such a degree that the a single web edge detector will not function satisfactorally. Typically, in these situations two web edge detectors are utilized to monitor or detect both longitudinal edges of the web, and to shift the web transversely accordingly to maintain the proper web alignment.

When movable web edge detectors are used, it is important that the web edge detectors be moved positively without hesitation and change directions rapidly without overrun in the initial direction of movement to precisely follow the undilating longitudinal edges of the web.

It is also very important that the moving web be transversely moved in the appropriate direction in response to a signal from the web edge detectors positively without hesitation and change directions rapidly without overrun in the initial direction of movement to precisely and rapidly correct the transverse deviations of the web from the desired path.

The heretofore known systems using two web edge detectors to sense transverse deviations in the position of a moving web and correct the deviations are deficient in one or more of these areas of concern.

In addition, the heretofore known systems are quite complicated and, therefore, expensive to manufacture and maintain in operation.

It is an object of the present invention to provide an apparatus having two web edge detectors which continuously move in a positive manner without hesitation and change direction rapidly without overrun.

It is another object of the present invention to provide an apparatus for transversely moving the web in response to a signal from the web edge detectors in a positive manner without hesitation and capable of changing direction rapidly without overrun.

It is a further object of the invention to provide an apparatus of the class described which is relatively straightforward and, therefore, relatively inexpensive to maintain in operation.

Other objects and advantages of the present invention will become known by reference to the following description and drawings in which.

Figure 1:
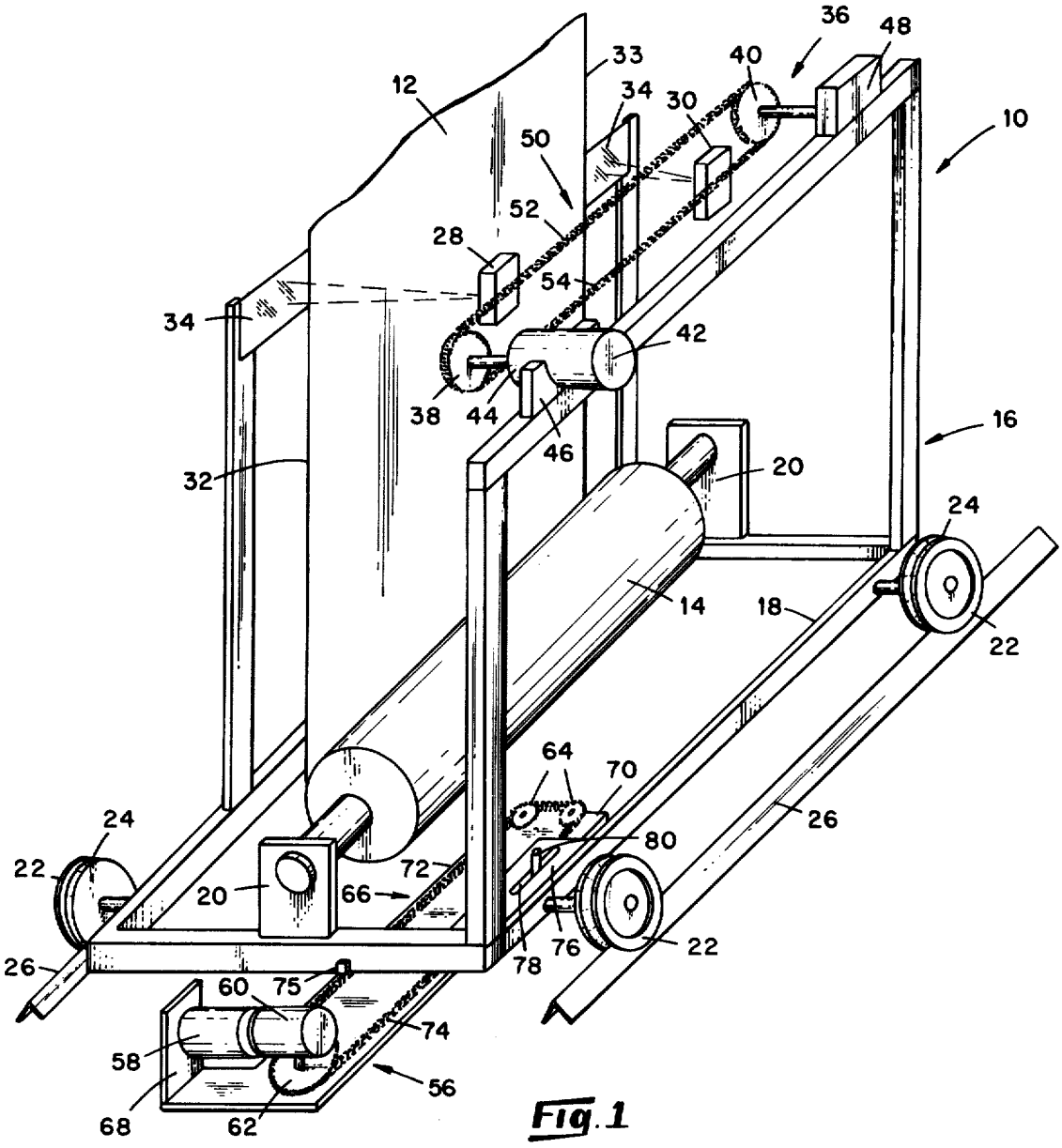
FIG. 1 is an isometric diagrammatic view of an apparatus for monitoring and controlling transverse deviations in a moving web of material embodying various features of the present invention.

The illustrated embodiments, in general, provide a centerline web guide apparatus 10 for detecting the transverse position of the centerline of a longitudinally moving web 12 feeding from a supply roll of material and transversely shifting the supply roll 14 to maintain the position of the web centerline along a desired path of travel.

The apparatus 10 comprises a supply roll support frame structure, generally denoted as the numeral 16, which is mounted for movement in the transverse direction of the moving web 12. The support frame structure 16 comprises a horizontally disposed frame structure 18, supply roll mounting brackets 20 attached to the horizontal structure 18 adapted to rotatably support the supply roll 14, and casters 22 rotatably connected to the horizontal frame structure 18. The casters 22 each have a peripheral groove 24 and ride on a pair of parallel spaced apart rails 26 with the rails seated in the grooves. The rails 26 extend transversely of the moving web 12.

The web centerline web guide apparatus 10 illustrated in FIG. 1 further includes a pair of spaced apart photoelectric detectors or photocells 28 and 30 mounted to the supply roll support frame structure 16 adjacent to either longitudinal edge 32 and 33 of the web 12 and to one side of the web. The photoelectric detectors 28 and 30 are mounted to the supply roll support frame structure 16 for simultaneous movement alternatively toward and away from each other in the transverse direction of the web 12. A light reflecting surface 34, such as, for example, a retro-tape, is mounted to the supply roll support frame structure 16 on the other side of the web 12 from the photoelectric detectors 28 and 30 and in-line with the photoelectric detectors 28 and 30 so as to reflect a light beam emitted by the photoelectric detectors 28 and 30 back to the photoelectric detectors unless the light path is otherwise blocked or interrupted by the web 12. As illustrated, the photoelectric devices 28 and 30 are movably mounted to the supply roll support frame structure 16 by means of a first chain and sprocket arrangement, generally denoted as the numeral 36. The first chain and sprocket arrangement 36 is illustrated as comprising a first sprocket 38 located near one longitudinal edge 32 of the web 12 toward one end of the supply roll support frame structure 16 and a second sprocket 40 located near the other longitudinal edge 33 of the web 12 toward the other end of the supply roll support frame structure 16. Thus, the first and second sprockets 38 and 40 are spaced apart from each other transversely of the web 12. The first sprocket 38 is rotatably driven by means of a reversibly electric motor 42 through a speed reducer 44, the first sprocket 38 being attached to the output shaft of the speed reducer 44 for rotation therewith. The electric motor 42 is, for example, of the type which come to speed rapidly, which are rapidly reversible and which do not coact excessively. Examples of such motors are alternating current, synchronous permanent magnet constant speed motors having a starting current the same as running current, and direct current stepping motors. The speed reducer 44 and electric motor 42 can be mounted to the supply roll support frame structure 16 by virtually any means such as, for example, a mounting bracket 46. The second sprocket 40 is an idler sprocket and is rotatably mounted to the supply roll support frame structure 16. The idler sprocket 40 can be rotatably mounted to the supply roll support frame structure 16 by virtually any means such as, for example, a journal mounting 48. An endless chain 50 encompasses both the first and second sprockets 38 and 40 to provide the driving engagement therebetween. One, or a first photoelectric device 28 is attached to one of the lengths 52 of chain 50 between the sprockets for movement with the chain, and the other or, second photoelectric device 30 is attached to the other length 54 of chain 50 between the sprockets for movement with the chain 50. Thus, as the reversible electric motor 42 rotates in one direction, for example, a counter-clockwise direction, it causes the first sprocket 38 to also rotate in a counter-clockwise direction. As this occurs, the length 52 of chain 50 to which the first photoelectric detector 28 is attached moves linearly toward the first sprocket 38 and the other length of chain 54 to which the second photoelectric detector 30 is attached to move linearly toward the second sprocket 40. Thus, the first and second photoelectric detectors 28 and 30 simultaneously move away from each other in the transverse direction of the web 12. Similarly, as the reversible electric motor 42 rotates in the other direction, for example a clockwise direction, it causes the first sprocket 38 to also rotate in a clockwise direction. As this occurs, the length 52 of chain 50 to which the first photoelectric detector 28 is attached moves linearly away from the first sprocket 38 and the other length 54 of chain 50 to which the second photoelectric detector 30 is attached to move linearly away from the second sprocket 40. Thus, the first and second photoelectric detectors 28 and 30 simultaneously move toward each other in the transverse direction of the web 12.

The supply roll support structure 16 is caused to move transversely of the web 12 by means of a second chain and sprocket arrangement 56 illustrated in fixed relationship relative to the frame structure 16. The second chain and sprocket arrangement 56 comprises a reversible electric motor 58 driving through a worm-type speed reducer 60. The reversible motor 58 and speed reducer 60 are located to one end of the movable supply roll support frame structure 16. A first or driven sprocket 62 is connected to the driven or output shaft of the speed reducer 60 for rotation therewith. At least one second or idler sprocket 64 is spaced from the driven sprocket 62 transversely of the web 12. An endless chain 66 encompasses the driven sprocket 62 and at least one idler sprocket 64. As illustrated in FIG. 1, the electric motor 58 and speed reducer 60 are located outside the periphery of the movable supply roll support frame structure 16, and the at least one idler sprocket 64 is located inside the periphery of the movable supply roll support frame structure 16. The electric motor 58 and speed reducer 60 are shown as being mounted to a stationary bracket member 68, and at least one idler sprocket 64 is shown as being journal mounted in a stationary mounting 70. Also as illustrated, the driven sprocket 62 and at least one idler sprocket 64 are oriented so that the plane of the endless chain 66 is horizontally disposed with the lengths 72 and 74 of chain between the driven sprocket 62 and at least one idler sprocket 64 disposed beneath the movable supply roll support frame structure 16.

One of the lengths 72 of chain 66 between the sprockets 62 and 64 is fixedly attached to the movable supply roll support frame structure 16 by means of, for example, a false link in the length 72 of chain 66 which is connected as at numeral 75 to the movable supply roll support frame structure 16 by means of virtually any type of conventional or otherwise convenient fastener such as, for example, a rivet or bolt.

The second chain and sprocket arrangement 56 is also illustrated as including an elongated bar 76 having an elongated slot 78 formed therein. The elongated bar 76 is connected to the movable supply roll support frame structure 16 and is oriented with the longitudinal axis of the elongated slot 78 in the transverse direction of the web 12. The other one of the lengths 74 of chain 66 between the sprockets 62 and 64 includes a pin 80 projecting from the chain and slidably received in the elongated slot 78 of the elongated bar 76 to guide the chain 66 and keep tension on the chain 66 so that the chain will track properly around the sprockets 62 and 64. The pin 80 can be attached to a false link in the chain 66.

As the reversible electric motor 58 of the second chain and sprocket arrangement 56 rotates in one direction, for example, a counter-clockwise direction, it causes the first sprocket 62 to also rotate in a counter-clockwise direction. As this occurs, the length 72 of chain 66 fixedly attached to the movable supply roll support frame structure 16 moves linearly toward the first sprocket 62 and the other length 74 of chain 66 moves linearly toward the at least one idler sprocket 64. As the length 72 of chain 66 moves toward the first sprocket 62 it pulls the movable supply roll support frame structure 16 towards the first sprocket 62 in a first transverse direction of the web 12. Similarly, as the reversible electric motor 58 rotates in the other direction, for example, a clockwise direction, it causes the first sprocket 62 to also rotate in a clockwise direction. As this occurs, the length 72 of chain 66 fixedly attached to the movable supply roll support frame structure 16 moves linearly away from the first sprocket 62 and the other length 74 of chain 66 to move linearly away from the at least one idler sprocket 64. As the length 72 of chain 66 moves away from the first sprocket 62 it pulls the movable supply roll support frame structure 16 toward the at least one idler sprocket 64 in a second transverse direction of the web opposite to the first transverse direction.

Figure 2:
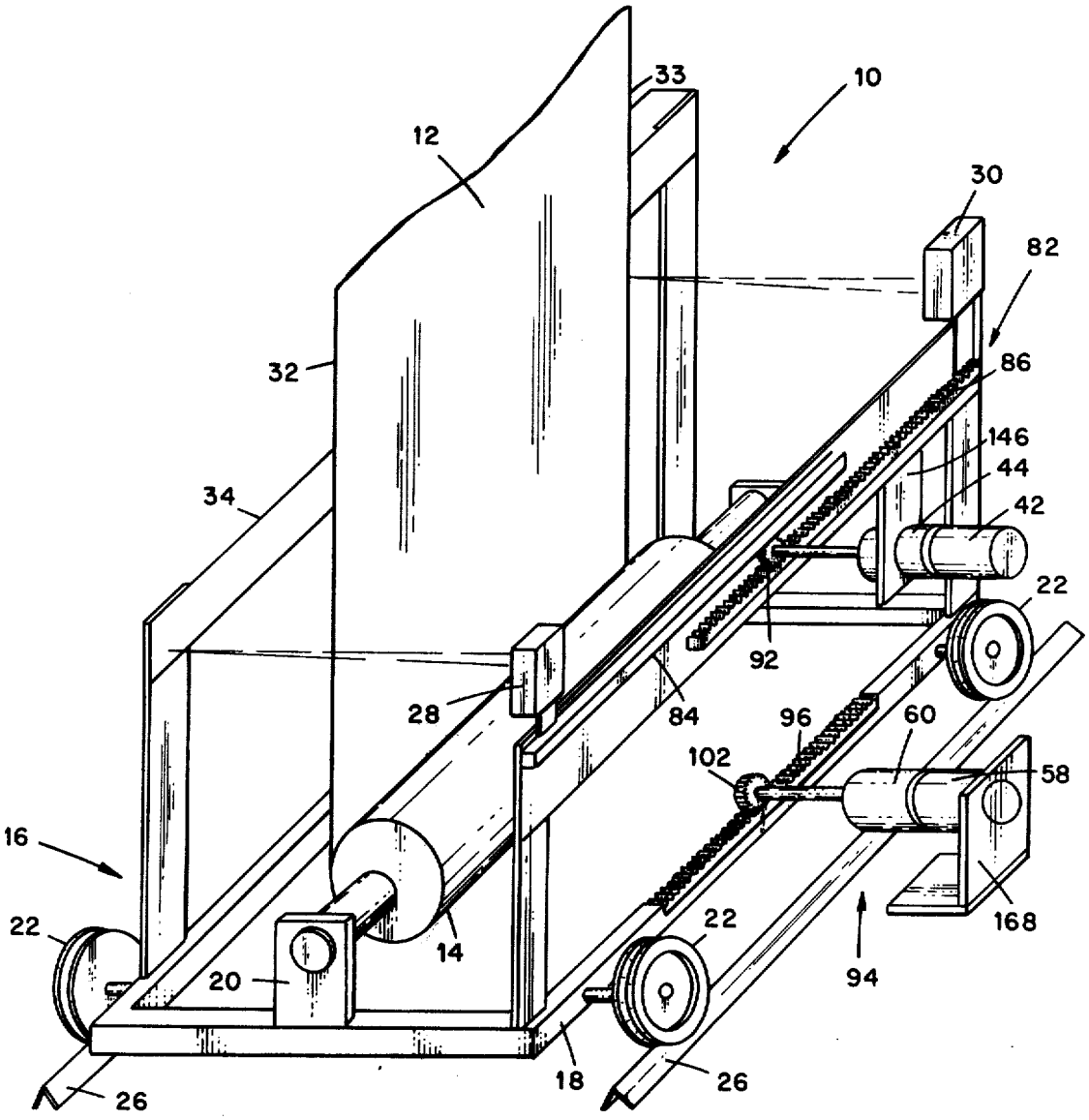
FIG. 2 is an isometric diagrammatic view of another embodiment of an apparatus for monitoring and controlling transverse deviations in a moving web of material embodying various features of the present invention; and, FIG. 3 is a schematic representation of a control circuit for the apparatus of FIG. 1 and FIG. 2.

In the embodiment illustrated in FIG. 2, the photoelectric detectors 28 and 30 are moved by means of a first rack and pinion arrangement, generally denoted as the numeral 82. The first rack and pinion arrangement 82 comprises a first gear rack 84 and a second gear rack 86 disposed in parallel spaced apart relationship to each other in a transverse direction of the web 12. Both gear racks 84 and 86 are mounted to the movable supply roll support frame structure 16 for movement relative to the movable supply roll support frame structure 16 in a direction transversely of the web 12. The reversible electric motor 42 and the speed reducer 44 are mounted to the supply roll support frame structure 16 by means of, for example, a mounting bracket 146. A pinion gear 92 is attached to the output shaft of the speed reducer for rotation therewith. The pinion gear 92 is disposed between the first and second gear racks 84 and 86, respectively, and is in meshing engagement with the gears of both gear racks 84 and 86. The first photoelectric detector 28 is attached to the first gear rack 84 for movement with the first gear rack 84 and the second photoelectric detector 30 is attached to the second gear rack 86 for movement with the second gear rack 86. As the electric motor 42 rotates counter-clockwise, the pinion gear 92 is caused to rotate counter-clockwise and the gear racks 84 and 86 move linearly in opposite directions transversely of the web 12 toward the lateral edges 32 and 33 of the web 12, respectively. The first photoelectric detector 28 moves with the first rack 84 and the second photoelectric detector 30 moves with the second rack 86 so that the photoelectric detectors 28 and 30 simultaneously move apart or away from each other transversely of the web 12. Similarly, as the electric motor 42 rotates clockwise, the pinion gear 92 is caused to rotate clockwise and the gear racks 84 and 86 move linearly in opposite directions transversely of the web 12 away from the lateral edges 32 and 33 of the web 12, respectively. The first photoelectric detector 28 moves with the first gear rack 84 and the second photoelectric detector 30 moves with the second rack 86 so that the photoelectric detectors 28 and 30 simultaneously move toward each other transversely of the web 12.

The movable supply roll support frame structure 16 is moved transversely of the web 12 by means of a second rack and pinion arrangement, generally denoted as the numeral 94. The second rack and pinion arrangement 94 comprises a gear rack 96 fixedly attached to the movable supply roll support frame structure 16 and extending longitudinally in the transverse direction of the web 12. The reversible electric motor 58 and speed reducer 60 is mounted in a fixed position relative to the movable supply roll support frame support 16 by means of, for example, a fixed position bracket 168. A pinion gear 102 is attached to the output shaft of the speed reducer for rotation therewith and is in meshing engagement with the gears of the gear rack 96. As the electric motor 58 rotates counter-clockwise, for example, the pinion gear 102 is caused to rotate counter-clockwise and due to the coaction between the pinion gear 102 and gear rack 96 the movable supply roll support frame structure 16 is caused to move in a first transverse direction of the web 12. Similarly, as the electric motor rotates clockwise, the pinion gear 102 is caused to rotate clockwise and, again due to the coaction between the pinion gear 102 and gear rack 96, the movable supply roll support frame structure is caused to move in a second transverse direction of the web 12 opposite to the first transverse direction.

Figure 3:
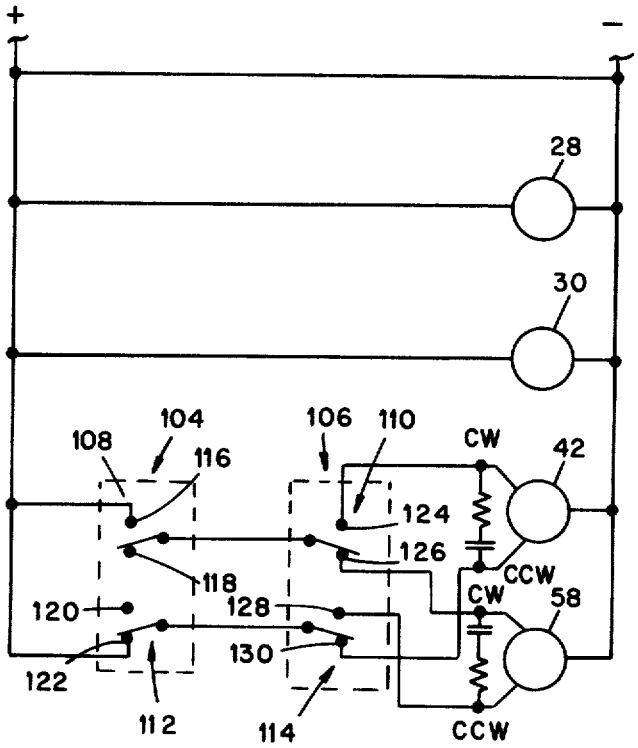

Now with reference to the schematic of the control circuit illustrated in FIG. 3, the control circuit comprises, a first double pole, double throw switch 104 of the first photoelectric detector 28 in series with a second double pole-double throw switch 106 of the second photoelectric detector 30. A first pole 108 of the first switch 104 is in series with a first pole 110 of the second switch 106 and a second pole 112 of the first switch 104 is in series with a second pole 114 of the second switch 106. In the first switch 104, the first pole 108 has a first switch contactor 116 electrically associated with the source of electrical energy and a second switch contactor 118, and the second role 112 has a first switch contactor 120 and a second switch contactor 122 which is electrically associated with the source of electrical energy. In the second switch 106, the first pole 110 has a first switch contactor 124 in series with, for example, the clockwise winding of the electric motor 42 driving the photoelectric detectors, and a second switch contactor 126 in series with, for example, the clockwise winding of the electric motor 58 driving the movable supply roll support frame structure 16, and the second pole 114 has a first switch contactor 128 in series with the counter-clockwise winding of the electric motor 58 driving the movable supply roll support frame structure and a second switch contactor 130 in series with the counter-clockwise winding of the electric motor 42 driving the photoelectric detectors 28 and 30. In the first switch 104, the first pole 108 is normally open and the second pole 112 is normally closed, as shown. In the second switch 106, the first pole 110 is normally closed against the second switch contactor 126 and the second pole 114 is normally closed against the second switch contactor 130, as shown.

For the sake of starting the discussion of the operation of the centerline guide system, it is assumed that the web 12 of material is interrupting the light beam reflected from the reflector tape 34 to both photoelectric devices 28 and 30. In this situation, the relay controlling the first and second switches 104 and 106 are de-energized. In this mode, the first pole 108 of the first switch 104 is in its normally open position and the second pole 112 of the first switch 104 is in its normally closed position while the first pole 110 of the second switch 106 is in its normal position closing the second switch contactor 126 and second pole 114 of the second switch 106 is in its normal position closing the second switch contactor 130. Thus, as can be seen from FIG. 3, no current will flow through the open first pole 108 of the first switch 104, however, current will flow through the closed second pole 112 of the first switch 104 and through the closed second pole 114 of the second switch 106 to the counter-clockwise winding of the reversible electric motor 42 for driving the photoelectric detectors. This energizes the reversible electric motor 42 to rotate counter-clockwise causing the photoelectric detectors 28 and 30 to simultaneously move apart in the transverse direction of the web 12 as discussed above. Now, further assuming that the web 12 is centered and of uniform width at this point, the photoelectric detectors 28 and 30 will continue to move apart or away from each other until they simultaneously move beyond the longitudinal edges 32 and 33 of the web 12 and are therefore exposed to reflected light from the reflector tape 34. When this occurs, the relays controlling the positions of the poles of the first and second switches 104 and 106 are energized closing the first pole 108 of the first switch 104 against the first switch contactor 116 and opening the second pole 112 of the first switch 104, activating the first pole 110 of the second switch 106 to close the first switch contactor 124, and activating the second pole 114 of the second switch 106 to close the first switch contactors 128. Thus, no current will flow through the open second pole 112 of the first switch 104, however, current will flow through the closed first pole 108 of the first switch 104 and through the closed first switch contactor 124 of the first pole 110 in the second switch 106 to the clockwise winding of the reversible motor 42 for driving the photoelectric detectors. This energizes the reversible motor 42 to rotate clockwise causing the photoelectric detectors 28 and 30 to simultaneously move toward each other in the transverse direction of the web 12 as discussed above. It can be seen from the foregoing discussion that as long as the web 12 remains centered with respect to its longitudinal edges 32 and 33 that the photoelectric detectors 28 and 30 will continue to oscillate toward and away from each other continuously monitoring the relative positions of the longitudinal web edges 32 and 33, but that the movable supply roll support frame structure 16 will remain stationary.

Let is be assumed that the web 12 is in a position interrupting the light beam reflected from the reflector tape 34 to both photoelectric detectors 28 and 30, but that the web 12 is beginning to run off-center with respect to its longitudinal edges 32 and 33. As mentioned above, in this situation both photoelectric detectors 28 and 30 simultaneously move apart or away from each other. However, because the web 12 is not centered relative to its longitudinal edges 32 and 33, one photoelectric detector will move beyond a longitudinal web edge before the other photoelectric detector. It is assumed here that the first photoelectric detector 28 moves beyond the adjacent longitudinal web edge 32 before the second photoelectric detector 30 moves beyond its adjacent lateral web edge 33. This corresponds to the web being off-center toward the second photoelectric detector 30. Therefore, the first photoelectric detector 28 is exposed to reflected light from the reflector tape 34 and the second photoelectric detector 30 remains shielded from reflected light by the web 12. When this occurs, the relay controlling the first switch 104 is energized and the relay controlling the second switch 106 remains de-energized. Energization of the relay of the first switch 104 closes the first pole 108 and opens the second pole 112 of the first switch 104. However, because the relay of the second switch 106 remains de-energized, the first pole 110 of the second switch 106 remains closed against its second switch contactor 126 and the second pole 114 remains closed against its second switch contactor 130. Thus, as can be seen from FIG. 3, no current will flow through the open second pole 112 of the first switch 104 and, therefore, the reversible electric motor 42 for moving the photoelectric detectors will be de-energized stopping any further movement of the photoelectric detectors 28 and 30. At the same time, current will flow through the closed first pole 108 of the first switch 104 to the first pole 110 of the second switch 106 and through the second switch contactor 126 of the first pole 110 of the second switch 106 to the clockwise winding of the reversible motor 58 for driving of the movable supply roll support frame structure 16 energizing the reversible motor 58 to rotate in the clockwise direction causing the movable supply roll support frame structure 16 to move transversely of the web 12 in a first transverse direction or toward the first photoelectric detector 28. The transverse movement of the supply roll support frame structure 16 in the first transverse direction toward the first photoelectric detector 28 continues until the longitudinal edge 32 of the web 12 interrupts the reflected light beam from the reflector tape 34 to the first photoelectric detector 28. This causes de-energization of the relay controlling the first switch 104 thus opening the first pole 108 and closing the second pole 112 and, therefore, de-energization of the reversible motor 58 for driving the movable supply roll support frame structure 16. Upon opening of the first pole 108 and closing of the second pole 112 of the first switch 104, the counter-clockwise windings of the reversible motor 58 for driving the photoelectric detectors 28 and 30 will be re-energized and the photoelectric detectors 28 and 30 resume moving apart from one another until one or the other, or both of them are again exposed to reflected light from the reflector tape 34. If the web 12 moves off-center with respect to its longitudinal edges 32 and 33 toward the first photoelectric detector 28, the second photoelectric detector 30 will be exposed to reflected light from the reflector tape 34 but the first photoelectric detector 28 will be shielded from the light beam by the web. In this event, the relay controlling the second switch 106 of the second photoelectric detector 30 will be energized and the relay controlling the first switch 104 of the first photoelectric detector 28 will remain de-energized. This causes the first pole 110 of the second switch 106 to close its first switch contactor 124 and the second pole 114 of the second switch 106 to close its first switch contactor 128 while the first pole 108 of the first switch 104 remains open and the second pole 112 of the first switch 104 remains closed. In this case current will not flow through the first pole 108 of the first switch 104, but will flow through the second pole 112 of the first switch 104 to the second pole 114 of the second switch 106, and through the first switch contactor 128 of the second pole 114 of the second switch 106 to the counter-clockwise windings of the reversible electric motor 58 for driving the movable supply roll support frame structure 16 energizing the reversible electric motor 58 to rotate in the counter-clockwise direction causing the movable supply roll support frame structure 16 to move transversely of the web 12 in a second transverse direction opposite the first direction or toward the second photoelectric detector 30. The transverse movement of the supply roll support frame structure 16 in the second transverse direction toward the second photoelectric detector 30 continues until the longitudinal edge 33 of the web 12 interrupts the reflected light beam from the reflector tape 34 to the second photoelectric detector 30. Interruption of the light to the second photoelectric detector 30 causes de-energization of the relay controlling the second switch 106, causing the first pole 110 of the second switch 106 to close its second switch contactor 126 and the second pole 114 of the second switch 106 to close its second switch contactor 130 resulting in de-energization of the reversible motor 58 for driving the supply roll support frame structure 16. Upon closing of the second switch contactor 126 of the first pole 110 and closing of the second switch contactor 130 of the second pole 114 of the second switch 106, the counter-clockwise windings of the reversible motor 42 for driving the photoelectric detectors will be re-energized and the photoelectric detectors 28 and 30 will resume moving apart from one another until one or the other, or both of them are again exposed to reflected light from the reflector tape 34 at which time the photoelectric detectors will reverse their direction and move toward each other as discussed above.

The foregoing detailed description is given primarily for clearness of understanding, and no unnecessary limitations should be understood therefrom for modifications will be obvious to those skilled in the art upon reading this disclosure and can be made without departing from the spirit of the invention or scope of the appended claims.

What is claimed is:

1. An apparatus for detecting the transverse position of a longitudinally moving web of material unwinding from a supply roll of material and transversely shifting the supply roll to maintain the position of the web centerline along a desired path, said apparatus comprising:

a supply roll support frame mounted for movement transversely of the web;

first and second spaced apart web edge detecting means disposed generally at either longitudinal edge of the web and mounted for concurrent movement toward and away from each other transversely of the web for detecting the transverse positions of the longitudinal edges of the web;

means for constantly moving said detecting means alternatively toward and away from each other in response to a signal from said detecting means; and, means for selectively moving said support frame transversely in response to a signal from said web edge detecting means indicating the web has moved transversely of the desired path for re-aligning the web centerline to the desired path of travel.

2. The apparatus of claim 1, wherein:

said means for moving said first and second web edge detecting means comprises a first reversible driving means drivingly associated with both said edge detecting means; and, said means for moving said support frame comprises a second reversible driving means drivingly associated with said support frame.

3. The apparatus of claim 2, wherein:

said means for constantly moving said first and second web edge detecting means further comprises first chain and sprocket means mounted to said supply roll support structure with the chain of said first chain and sprocket means disposed transversely of the web, and said first driving means is drivingly associated with a sprocket of said first chain and sprocket means;

said first web edge detecting means is attached to one of the lengths of said chain for linear movement therewith; and, said second web edge detecting means is attached to the other one of the lengths of said chain for linear movement therewith.

4. The apparatus of claim 2, wherein said means for selectively moving said support frame further comprises:

second chain and sprocket means in fixed relationship relative to said support frame with the chain of said second chain and sprocket means disposed transversely of the web;

one length of said chain being attached to said support frame; and, said second reversible driving means is drivingly associated with a sprocket of said second chain and sprocket means.

5. The apparatus of claim 4, wherein the other length of chain of said second chain and sprocket means is mounted to said support frame for movement relative thereto in the transverse direction of the web.

6. The apparatus of claim 2, wherein:

said means for constantly moving said first and second web edge detecting means further comprises first rack and pinion means mounted to said support frame for movement relative thereto, said first reversible driving means being drivingly associated with the pinion; and, said means for selectively moving said support frame further comprises second rack and pinion means mounted to said support frame, said second reversible driving means being drivingly associated with the pinion.

7. The apparatus of claim 6, wherein said first rack and pinion means further comprises:

a first gear rack mounted to said support frame for longitudinal movement relative to said support frame transversely of the web;

a second gear rack mounted to said support frame for longitudinal movement relative to said support frame transversely of the web;

both said first and second gear racks being in mesh with the pinion;

said first web edge detector being attached to said first gear rack for movement therewith; and, said second web edge detector being attached to said second gear rack for movement therewith.

8. The apparatus of claim 6, wherein said second rack and pinion means comprises:

a gear rack fixedly mounted to said support frame generally transversely of the web; and, the pinion driven by said second reversible driving means being in a fixed position relative to said support frame.

9. The apparatus of claim 1, wherein:

said first and second web edge detecting means are photoelectric cells with associated light sources;

said first reversible driving means is a reversible electric motor;

said second reversible driving means is a reversible electric motor; and, a light reflective surface is disposed to the opposite side of the web from that side thereof from said photoelectric cell web edge detectors and positioned to reflect light back to said photoelectric cell web edge detectors.

10. The apparatus of claim 9, wherein said means for moving said photoelectric detectors and said means for moving said support frame further comprises:

a first double pole, double throw switch electrically associated with said first photoelectric detector;

a second double pole, double throw switch electrically associated with said second photoelectric detector;

a first pole of said first switch being in series with a first pole of said second switch, and a second pole of said first switch being in series with a second pole of the second switch;

one switch contactor of said first pole of said second switch being electrically associated with the clockwise windings of said first reversible electric motor, and the other switch contactor of said first pole of said second switch being electrically associated with clockwise windings of said second reversible electric motor; and, one switch contactor of said second pole of said second switch being electrically associated with the counter-clockwise windings of said second reversible electric motor, and the other switch contactor of said second pole of said second switch being electrically associated with the counter-clockwise windings of said first reversible electric motor.

* * * * *